US008661768B2

(12) United States Patent
Alkhrdaji et al.

(10) Patent No.: US 8,661,768 B2
(45) Date of Patent: Mar. 4, 2014

(54) REINFORCED BALCONY AND METHOD OF REINFORCING A BALCONY

(75) Inventors: Tarek Alkhrdaji, Ellicott City, MD (US); Jay Thomas, Baltimore, MD (US)

(73) Assignee: Structural Technologies, LLC, Hanover, MD (US)

( * ) Notice: Subject to any disclaimer, the term of this patent is extended or adjusted under 35 U.S.C. 154(b) by 0 days.

(21) Appl. No.: 13/444,831

(22) Filed: Apr. 11, 2012

(65) Prior Publication Data

US 2012/0260601 A1 Oct. 18, 2012

Related U.S. Application Data

(60) Provisional application No. 61/516,878, filed on Apr. 11, 2011.

(51) Int. Cl.

| | |
|---|---|
| ***E04B 1/00*** | (2006.01) |
| ***E04G 21/00*** | (2006.01) |
| ***E04G 23/00*** | (2006.01) |

(52) U.S. Cl.

USPC ..... 52/741.15; 52/282.1; 52/293.3; 52/296; 52/374; 52/832; 256/65.14; 256/65.16

(58) Field of Classification Search

USPC ..... 52/241, 282.1, 293.3, 296, DIG. 17, 52/309.2, 309.7, 344, 374, 832, 742.13, 52/741.15, 334, 698; 256/66, 65.01, 256/65.02, 65.04, 65.14, 65.15, 65.16, 65.1, 256/59, 25, 30

See application file for complete search history.

(56) References Cited

U.S. PATENT DOCUMENTS

| | | | | |
|---|---|---|---|---|
| 3,298,144 | A * | 1/1967 | Fischer | 52/98 |
| 3,918,686 | A * | 11/1975 | Knott et al. | 256/59 |
| 3,955,800 | A * | 5/1976 | Russo | 256/59 |
| 4,461,461 | A * | 7/1984 | Caron | 256/19 |
| 4,793,162 | A * | 12/1988 | Emmons | 404/69 |
| 4,841,703 | A * | 6/1989 | Grimaud | 52/334 |
| 4,892,292 | A * | 1/1990 | Russell | 256/66 |
| 5,029,818 | A * | 7/1991 | Katz | 256/22 |
| 5,049,015 | A * | 9/1991 | Sawaide et al. | 411/82.1 |
| 5,562,377 | A * | 10/1996 | Giannuzzi et al. | 411/82 |
| 5,816,014 | A * | 10/1998 | Tzeng et al. | 52/745.19 |
| 6,393,795 | B1 * | 5/2002 | Irwin et al. | 52/698 |
| 6,416,256 | B1 * | 7/2002 | Surjan et al. | 405/259.5 |
| 6,418,684 | B1 * | 7/2002 | Morton | 52/293.2 |
| 6,907,697 | B2 * | 6/2005 | Gergely et al. | 52/293.3 |
| 7,574,840 | B1 * | 8/2009 | Fyfe | 52/582.1 |
| 7,716,887 | B2 * | 5/2010 | Fouch et al. | 52/293.3 |
| 7,810,293 | B2 * | 10/2010 | Gibbar et al. | 52/309.7 |
| 7,930,863 | B1 * | 4/2011 | Fyfe | 52/582.1 |

* cited by examiner

*Primary Examiner* — Chi Q Nguyen

(74) *Attorney, Agent, or Firm* — Troutman Sanders LLP; Ryan A. Schneider

(57) ABSTRACT

Systems and methods for reinforcing a concrete slab or balcony are disclosed. The systems and methods may include cutting a groove in a portion of the concrete slab and inserting a rod into the groove. The groove may then be filled with a resin. The rod may optionally be secured by other or additional methods. The integrity of the concrete slab or balcony may then be strengthened by the inclusion of the rod in the slab.

9 Claims, 7 Drawing Sheets

REINFORCED BALCONY AND METHOD OF REINFORCING A BALCONY

CROSS-REFERENCE TO RELATED APPLICATIONS

This application claims priority under 35 U.S.C. §119(e) to U.S. Provisional Patent Application Ser. No. 61/516,878, filed on Apr. 11, 2011, which is hereby incorporated herein by reference in its entirety as if fully set forth herein.

TECHNICAL FIELD

The invention relates to a strengthened concrete slab comprising a post and methods of reinforcing and/or strengthening a concrete slab, for example the concrete slab of a balcony or other concrete slab comprising a railing, fence, billboard or other structure comprising a post embedded in the concrete slab. Embodiments of the strengthened concrete slab are particularly useful for concrete balconies comprising a railing having posts embedded in the concrete.

BACKGROUND

Buildings are designed to withstand certain loads depending on their anticipated use wind forces depending on their location. Buildings are designed to withstand a design wind speed. The design wind speed used to design the structure depends on the location of the building and is based upon the historical records of winds in that particular location. The design wind speed is determined by using an extreme value theory to predict future extreme wind speeds for the location and a further safety factor may be added to that value.

Hotel, condominium and apartment buildings typically comprise a balcony to provide access to the outside for the occupants. The balconies typically comprise a concrete slab with posts embedded in the concrete for supporting a railing. The posts embedded in the concrete slab must support the railings against any potential winds. The railings under high wind will exert a force on the concrete slab which may result in damage or even failure of the concrete slab. Especially applicable to concrete slabs which have degradated, were improper designed or improperly constructed.

Many owners delay repairing or strengthening their balconies to withstand design wind speeds due to the cost and inconvenience associated with the repair process. However, cracked or poorly constructed balconies represent a significant safety hazard and the cost of repairing the balconies after significant damage occurs is more expensive.

Naturally, all aspects of a building must be maintained to ensure the safety of the structure and the occupants. Spalling and deteriorating concrete on balconies is not merely a nuisance but a liability that could jeopardize the safety of the general public as well as owners. If someone were to incur an injury due to concrete deterioration it would be a very serious liability for the building association.

Thus, there is a need for a method of strengthening concrete slabs of balconies to resist the forces exerted on the concrete slabs under design wind forces. There is also a need for a method of calculating the amount of force exerted by posts within the concrete slab by design wind forces exerted upon a railing.

BRIEF SUMMARY OF THE INVENTION

Methods of strengthening a concrete slab and strengthened concrete slabs are described. One embodiment of the method of strengthening a concrete slab to support railing loads may comprise cutting a groove adjacent an edge of the balcony slab in front of a railing post, inserting a rod into the groove; and filling the groove with a polymeric resin. The groove may be on the front face of the concrete slab. The front face may be adjacent to an embedded post to strengthen a portion of the concrete slab between the embedded post and the front face. The method may further comprise securing the rod within the groove such as, but not limited to, applying an adhesive resin to at least one surface of the groove. The rod may also be secured mechanically with anchors or connectors installed in the concrete, for example.

Other aspects and features of embodiments of the method and the strengthened concrete slab will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more particular embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DETAILED DESCRIPTION OF PREFERRED EMBODIMENTS

Figure 1:
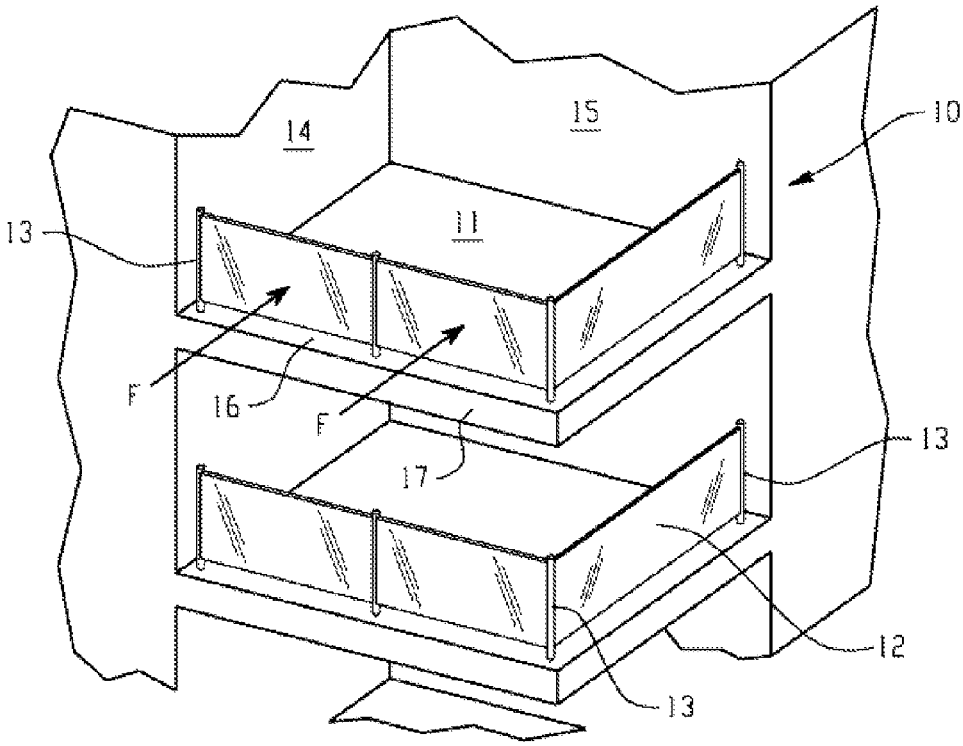
FIG. 1 is a schematic drawing of a typical balcony structure of a condominium, apartment, hotel or office building.

Embodiments of this invention are directed toward a strengthened concrete slab comprising a post and methods of reinforcing and/or strengthening a concrete slab, for example the concrete slab of a balcony or other concrete slab comprising a railing, fence, billboard or other structure comprising a post embedded in the concrete slab. Embodiments of the strengthened concrete slab are particularly useful for concrete balconies comprising a railing having posts embedded in the concrete such as the balconies on condominiums, apartments, hotels, office buildings or similar structures. A typical balcony is shown in FIG. 1. The balcony 10 in FIG. 1 comprises a balcony floor 11. The balcony floor is typically a rebar reinforced concrete slab that was poured during construction of the building. The balcony of FIG. 1 has two open sides and two sides adjacent to a building including a side wall 14 and a back wall 15. A railing 12 is provided on the open sides of the balcony 10 for safety. In many cases, as in the embodiment of the railing 12 shown in FIG. 1, a railing 12 may be made of glass or other transparent material so that the railing does not significantly interfere with the view from the balcony 10 itself or any room adjacent to the balcony. In such cases however, the flat surface of the railing 12 is capable of catching the full force of the wind. Typically, as shown in the figures, the railing 10 is supported on the balcony 10 by posts 13 embedded in the rebar reinforced concrete slab 11. The posts 13 support the railing 12 and resist movement of the railing when forces are exerted on the railing 12 such as a person or persons leaning on the railing or the force of wind F exerted on the flat surface of the railing 12. The force of wind F is exerted on the railing 12 at least in the direction shown by the arrow F in FIG. 1. The force of the wind results in an opposite force exerted on the concrete structure 11 in an area 16 between the posts 13 and the edge of the balcony 17 to prevent movement of the posts and railing. The concrete slab, though may be reinforced conventionally with rebar, may not be properly constructed to withstand the forces exerted on the edge of the concrete slab by the wind force transferred from the railing through the posts into the concrete slab. The concrete slabs of such balconies may require strengthening to avoid failure when the structure is exposed to design wind speeds.

Figure 2:
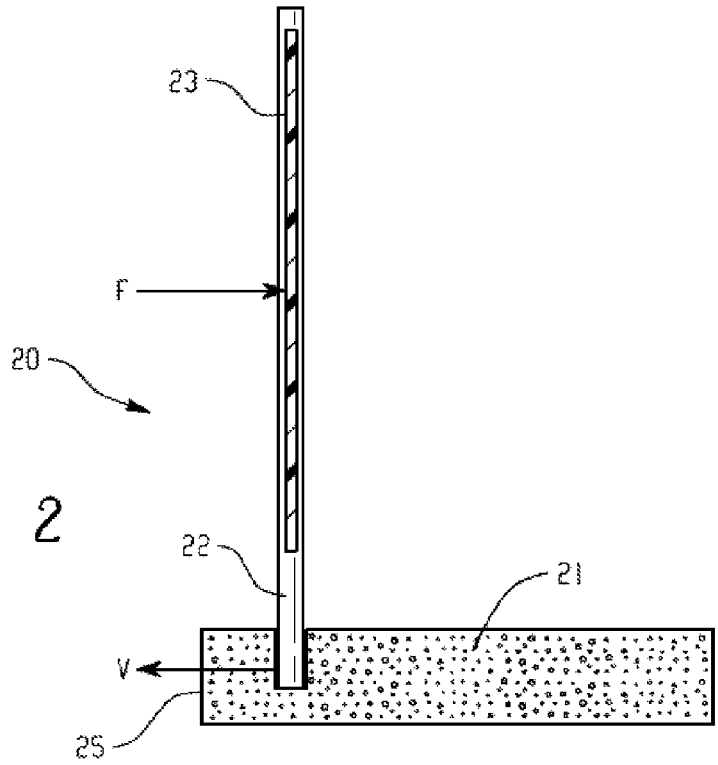
FIG. 2 is a cross-sectional view of a balcony comprising a concrete slab with a post supporting a railing embedded in the concrete slab showing the wind force, F, being exerted on the railing and the resultant force, V, exerted within the concrete slab of a balcony.

Embodiments of the method of strengthening a concrete slab of a balcony having a railing may comprise cutting a groove on the front face of a concrete slab adjacent to the railing or between an edge of the balcony and a post embedded in the concrete slab, inserting a rod into the groove and filling the groove, the groove may be filled with concrete, mortar or, a polymeric resin, for example. Further embodiments include a balcony comprising a concrete slab with a groove in the front edge of the slab and a rod embedded in the groove. The balcony may further comprise a resin in the groove covering the rod and securing the rod in the groove. The embedded rod provides structural support to the concrete, in specific embodiments; the rod provides structural support to the concrete edge in a portion adjacent a post 22. FIG. 2 depicts a cross-sectional view of a balcony 20 having a concrete slab 21 and the post 22 supporting a railing 23 embedded in the balcony concrete floor 21. The force F of the wind pushes against the railing 23 and the post 22 resulting in a force V in the opposite direction within the concrete slab 21 especially in a edge portion of the balcony floor 21 between the post 22 and the balcony edge 25. The greater the wind force F, the greater the resulting force V on the concrete slab will be for any particular railing and post design and the greater chance of failure of the concrete slab. In coastal areas, especially areas in hurricane zones, wind speeds can result in high force V exerted within the concrete slab resulting in weakening and ultimately failure of the concrete slab 21 in a region between the post 22 and the front edge of the concrete slab 25.

Figure 3:
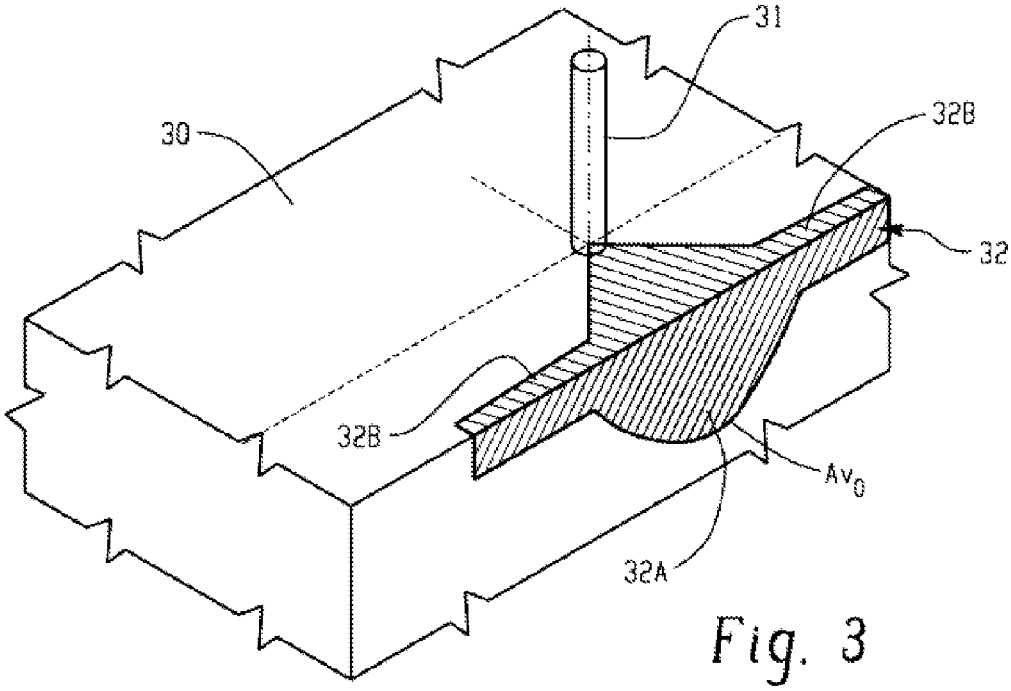
FIG. 3 is a schematic drawing of a concrete slab with an embedded post showing a typical failure mode of the concrete slab due to forces exerted with the slab by the post.

FIG. 3 is a schematic showing the failure mode and the concrete breakout block 32 of a concrete slab 30 with a post 31 embedded in the top surface when a force is exerted against the post. The breakout block comprises a central parabolic portion and two rectangular portions on either side of the central parabolic portion.

Figure 4:
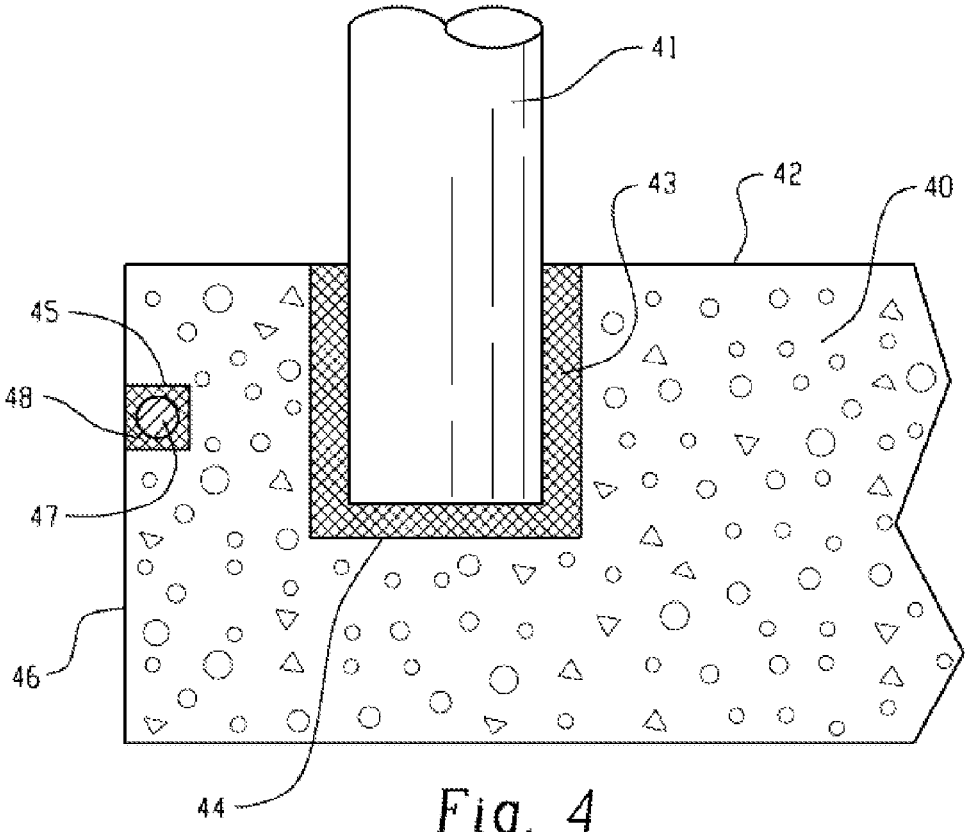
FIG. 4 is a cross-sectional view of a strengthened concrete slab comprising a rod installed on the front face of the concrete slab.

FIG. 4 depicts an embodiment of a strengthened concrete slab. The strengthened concrete slab 40 comprises a railing post 41 embedded the top surface 42 and secured with grout 43 in a recess 44 in the concrete slab 40. A groove 45 has been cut in the front surface 46 of the concrete slab 40. A rod 47 is secured in the groove 45 with an adhesive resin 48. The rod 47 strengthens the front surface 46 of the concrete slab 40 to resist the wind forces against a railing attached to the post 41.

Thus, embodiments include a method of strengthening a concrete slab to support railing loads. The embodiments of the method may comprise cutting a groove adjacent to an edge of the concrete slab in front of a railing post, inserting a rod into the groove, and filling the groove with a polymeric resin. The groove may be cut in a top surface of the concrete slab between a post and the front edge or in the front edge of the concrete slab, for example. The rod should be installed in the concrete slab in a location where the rod will experience the forces exerted on the post to strengthen a portion of the concrete slab that is stressed by the location of the post. The resin may be any resin that is capable of securing the rod in the groove. The rod may be metallic or nonmetallic. In certain embodiments, the rod may be a fiber reinforced rod such as a glass or carbon or graphite fiber reinforced rod. Embodiments of the method may comprise any method of cutting or routing a groove in the concrete slab such as with a hand-held saw or a wall chaser.

Still further embodiments of the method may comprise applying an adhesive resin to at least one surface of the groove. The adhesive may be applied in the groove before and/or after the rod is inserted in the groove. The adhesive provides a secure bonding of the rod with the concrete slab.

Specific embodiments of the method are particularly useful for strengthening the concrete slab of a balcony. However, different buildings may have different structures for supporting their balconies. The front of the balcony concrete slab may be adjacent to at least one vertical wall, for example. In such a case, embodiments of the method of strengthening the concrete slab may comprise drilling a hole in the vertical wall at a point wherein the groove in the concrete slab would intersect with the vertical wall. In such an embodiment, the method of strengthening the concrete slab may comprise applying an adhesive in the groove and in the hole to bond the rod with the vertical wall and the concrete slab. Typically, the vertical wall will be made of concrete; however, the method is applicable to vertical walls of other materials also. Therefore, embodiments of the method may comprise inserting the rod into the hole and into the groove. Additionally, the balcony structure may comprise other obstructions. In certain instances, cutting the groove in the concrete slab may be limited by the physical obstruction, therefore methods may further comprise extending the groove by drilling a hole into or through the obstruction. The rod may further need to be inserted and adhesive applied to the hole in the obstruction.

Further methods of reinforcing a concrete structure comprising a railing, comprise calculating a wind force on the railing with posts supported in the concrete structure, calculating the force to be resisted by the concrete structure based upon the wind force on the railing, determine the break out capacity of a reinforced concrete edge adjacent the posts, determining a size, depth, and length of a rod to install in the concrete structure to resist the wind force, and installing the rod in the concrete structure on an edge of the balcony in front of the posts. The wind force on the railing may be calculated by using factors such as, but not limited to, a height of the railing, post spacing of the railing, and a height of the lever arm of the force acting on the railing, for example. In addition, the break out capacity of the concrete edge may performed by using factors such as, but not limited to, a depth of the post embedded in the concrete structure, edge distance of the railing post, thickness of the concrete balcony, compressive strength of the concrete, and shear strength of the rod, for example.

Tests were conducted to verify that strengthened concrete slabs would resist failure if a railing supported by posts embedded in the concrete slab was exposed to a wind design pressure of 98.5 psf wind pressure. For testing, concrete slabs were prepared, a railing post was installed, and a FRP rod was installed in the slab to produce a strengthened concrete slab. The strengthened concrete slab was tested by applying a force to the railing post to simulate wind forces on a balcony railing and measure the force resisted by the strengthened concrete slab before failure. The test protocol was designed to verify the ability of the railing posts embedded in strengthened concrete slabs to resist the specified design wind loads without failure of the strengthened slab edge. Two tests were performed on strengthened concrete slabs with steel railing posts installed; one test on posts with 3" embedment and a record test with posts with 4" embedment to determine the load capacity strengthened slab.

EXAMPLES

Testing Surface-Embedded GFRP Bars System

Concrete slabs comprising railing posts may fail according to the failure mode described above. The concrete slab may be strengthened by embedding a glass fiber reinforced polymer (GFRP) bar in the concrete slab.

Example 1

Testing of Strengthen Concrete Slabs

A concrete slab was strengthened by embedding a GFRP bar in a front edge of the concrete slab according to the methods described above. In these examples, an FRP bar was installed in a groove cut onto the front side face of the concrete slab and bonded in place using an epoxy adhesive as shown in FIG. 4. The groove was dimensioned to ensure complete encapsulation of the GFRP bar with adhesive or other resin. In this example, the GFRP bar is a V-Wrap #5 glass FRP (GFRP) bar. The GFRP bar has a tensile modulus ($E_f$) of 5,920 ksi, ultimate tensile strength ($f_{fu}$) of 95 ksi, and a rupture strain ($\epsilon_{fu}$) of 1.6 percent and the adhesive for bonding the GFRP bars in the groove was HS-200 HV™ Epoxy Anchoring Gel, manufactured by Adhesives Technology, Pompano Beach, Fla.

Preparation of the Concrete Slabs

Figure 5A:
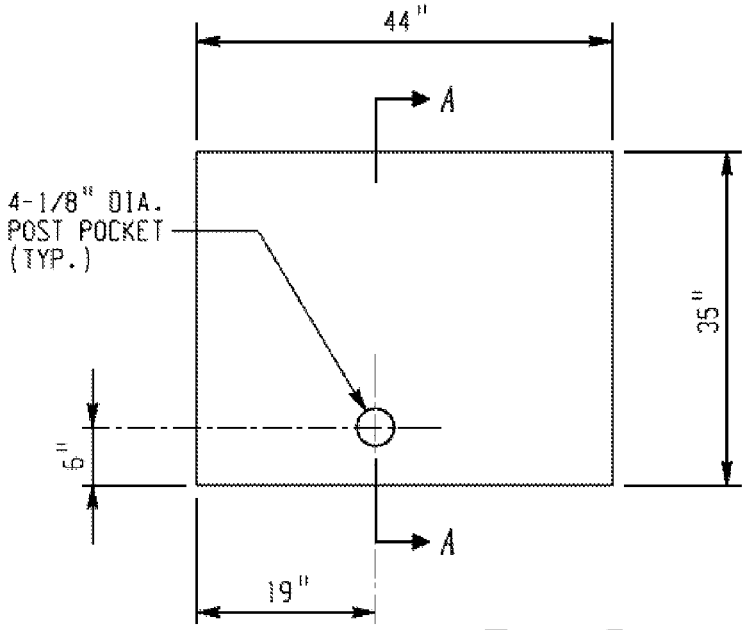
FIGS. 5A, 5B and 5C are schematic drawings of strengthened concrete slabs prepared as described in Example 1.
Figure 5B:
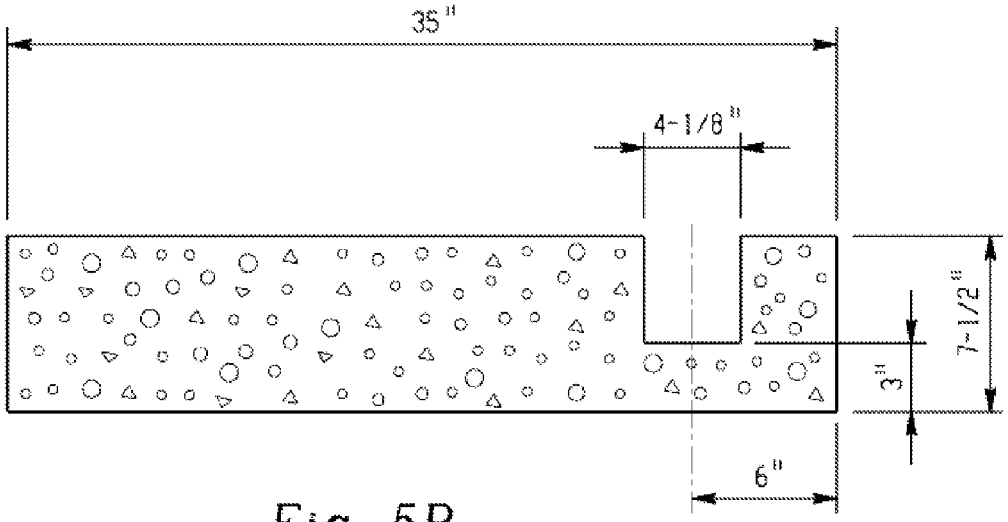

Each test was performed on a concrete slabs with the following dimensions: 44" long×35" wide×7½"thick. Each slab had one post pocket of 4⅛" diameter and 4½" deep installed along the one of the longer sides of the slab, approximately 3" from the edge of the slab, as shown in FIGS. 5A and 5B.

In preparation of testing, a steel railing post (3"×3"×3/16" HSS) was installed and fixed to each concrete slab using Sonopost Anchoring Grout by BASF. The location on the railing post and embedment depth is shown in FIGS. 5A and 5B.

Strengthening the Concrete Slabs

Figure 5C:
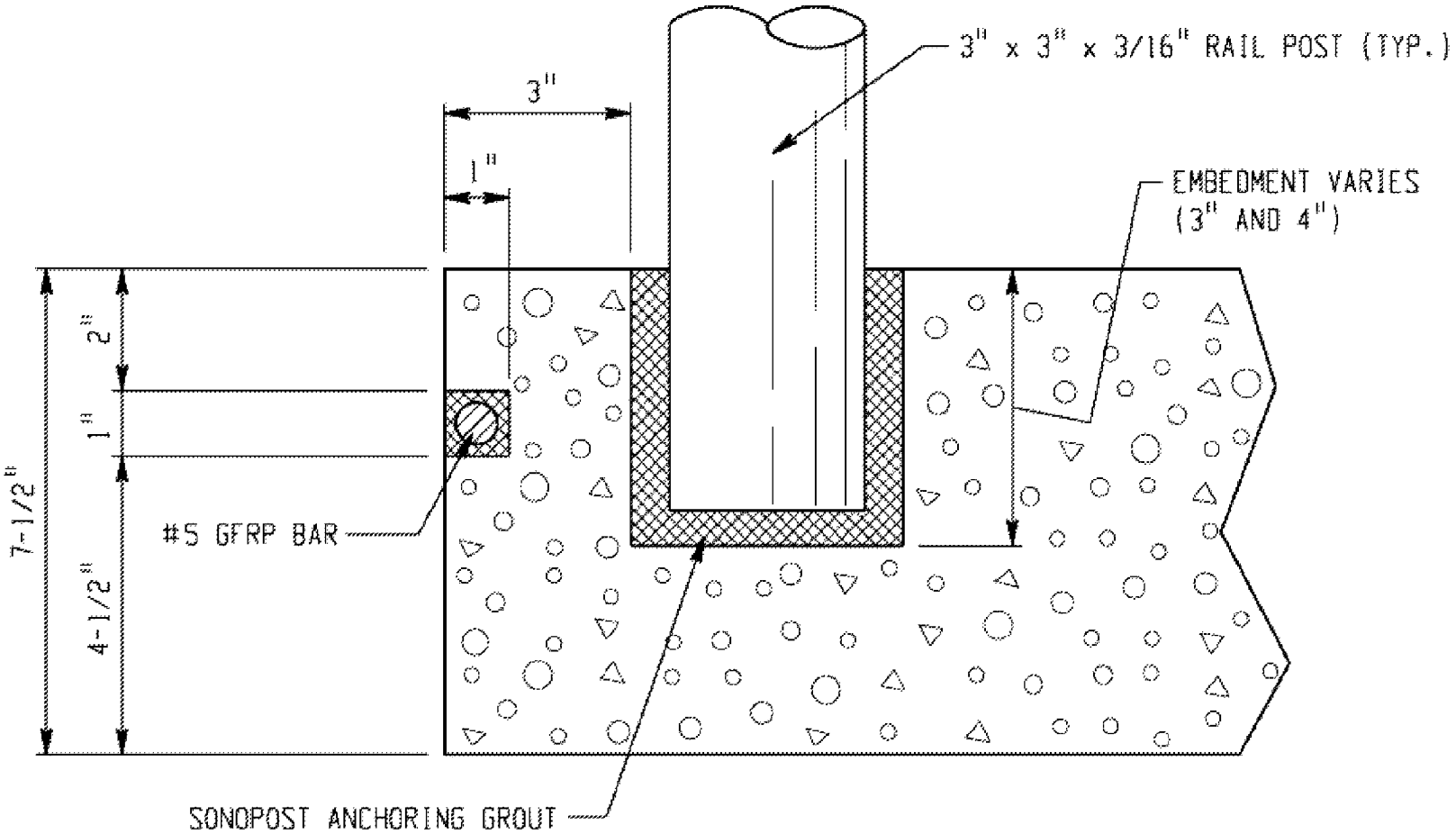

A 1"×1" groove was cut in each test slab as shown in FIG. 5C. A 36" long piece of #5 V-Wrap GFRP bar was then installed in the 1"×1" groove in each test slab and centered on each test post to prepare the strengthened concrete slab. FIG. 5C shows typical details of a cross-section of the tested strengthened concrete slab edge after installation of the steel post and the embedded GFRP bar.

FRP Rod Installation in the Concrete Slabs

The following procedure was followed to install the GFRP rod in the front edge of the concrete slabs according to the design and layout shown in FIG. 5C:

1. A groove 1" wide×1" deep was cut on the front face of the concrete slab with a 2" distance from the top surface of the slab;
2. The surface of the groove was cleaned using mechanical brushing (wire wheel), then the remaining dust or loose particles were removed using clean pressurized air;
3. The adhesive was applied within the groove.

Preferably, the adhesive is applied with a manual or pneumatic gun capable of delivering a consistent bead of adhesive so that the bar may be fully encapsulated in the adhesive. Mixing, if necessary, of the adhesive shall be in accordance with the manufacturer's specifications. Fumed silica or other fillers approved by the manufacturer may be added to the adhesive to modify the consistency, wherein the maximum ratio of the filler shall be in accordance with the manufacturer's specifications.

Test Procedure

Figure 6:
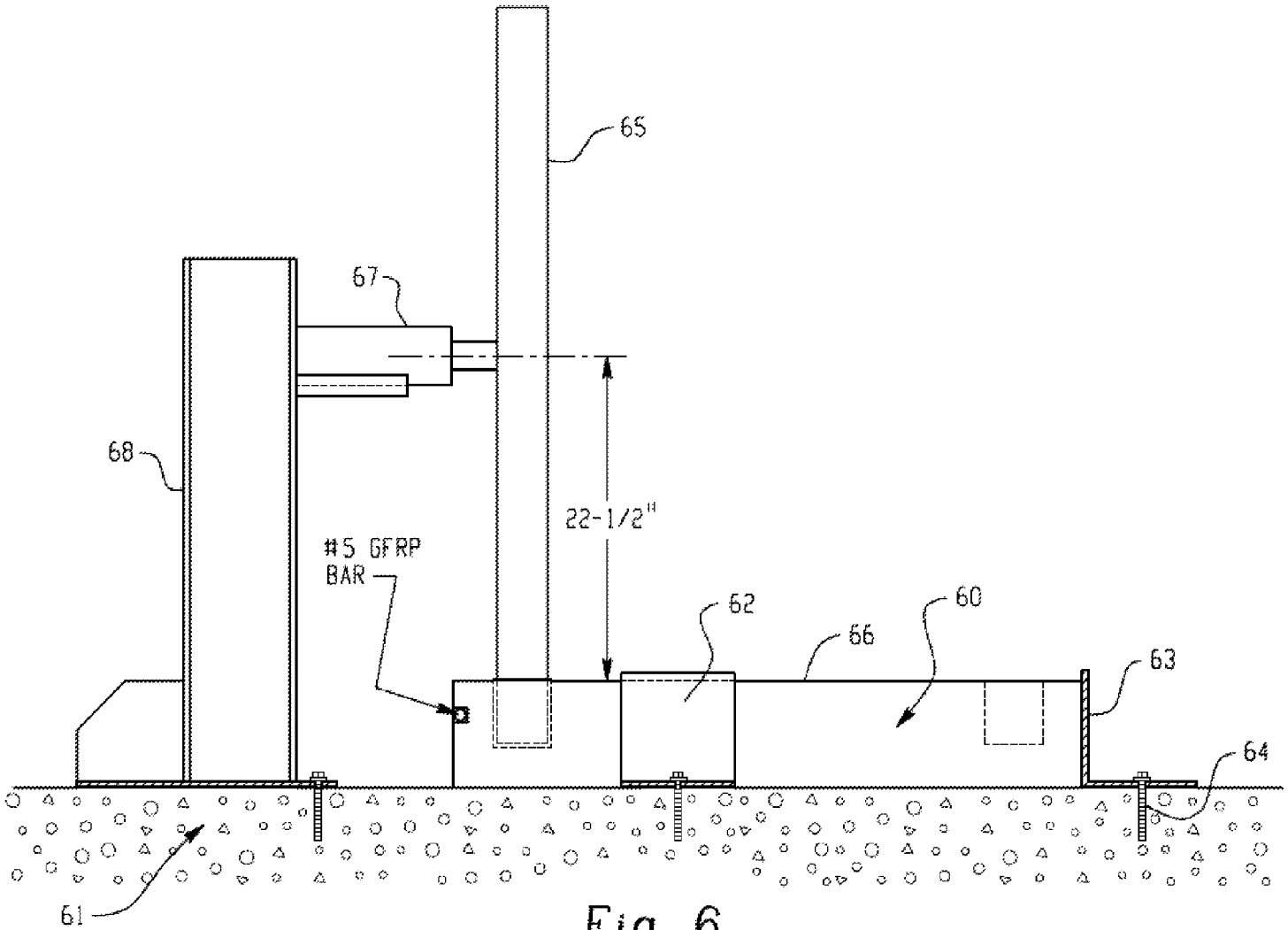
FIG. 6 is a schematic drawing of a test set up as described in Example 1.

Each slab was tested using the following procedure:

1. The concrete slab was setup as detailed as shown in Figure C.
2. The slab 60 was supported on concrete test floor 61 and restrained against movement using two steel 8"×8"×⅜" steel angles welded to a 8"×8" steel plate 62 on both sides (one shown) and a 8"×8"×⅜" steel angle 63, mechanically anchored to the test floor using ⅝" mechanical anchors 64, as shown in Figure C.
3. The test load was applied to each post 65 at 22½" from the top surface 66 of the slab using a 10-ton hydraulic cylinder 67 reacting against a steel post 68 anchored to the test floor, as shown in FIG. 6.
4. The test was commenced only after all materials have reached their design strengths, including concrete, cementitious grout, and adhesive resins.
5. Loading operation was performed under the control of a person experienced with the use of hydraulic jacks.
6. Testing loads were applied using the hydraulic jack, equipped with a calibrated hydraulic pressure gage or load cell that has been calibrated no more than 12 months prior to test date.
7. The load was monotonically applied up to failure using increments of 200 psi (pressure gauge) or 500 lbs (load cell) (whichever is less) every 30 seconds. Once the "pass" load specified in Table 2 was reached, the load was maintained for at least 2 minutes, before proceeding to the next load level.
8. Loads at onset of cracking and failure of the slab were recorded.

Test Load Magnitude and Failure Conditions

All tests were performed until failure of the railing post is achieved. As used herein "failure of the railing post" is defined as a collapse of the railing post, complete separation of the concrete slab edge and the GFRP bar from the rest of the concrete slab, or when the test load drops below 50% of the maximum test load value occurring during the test.

Acceptance Criteria

Figure 7:
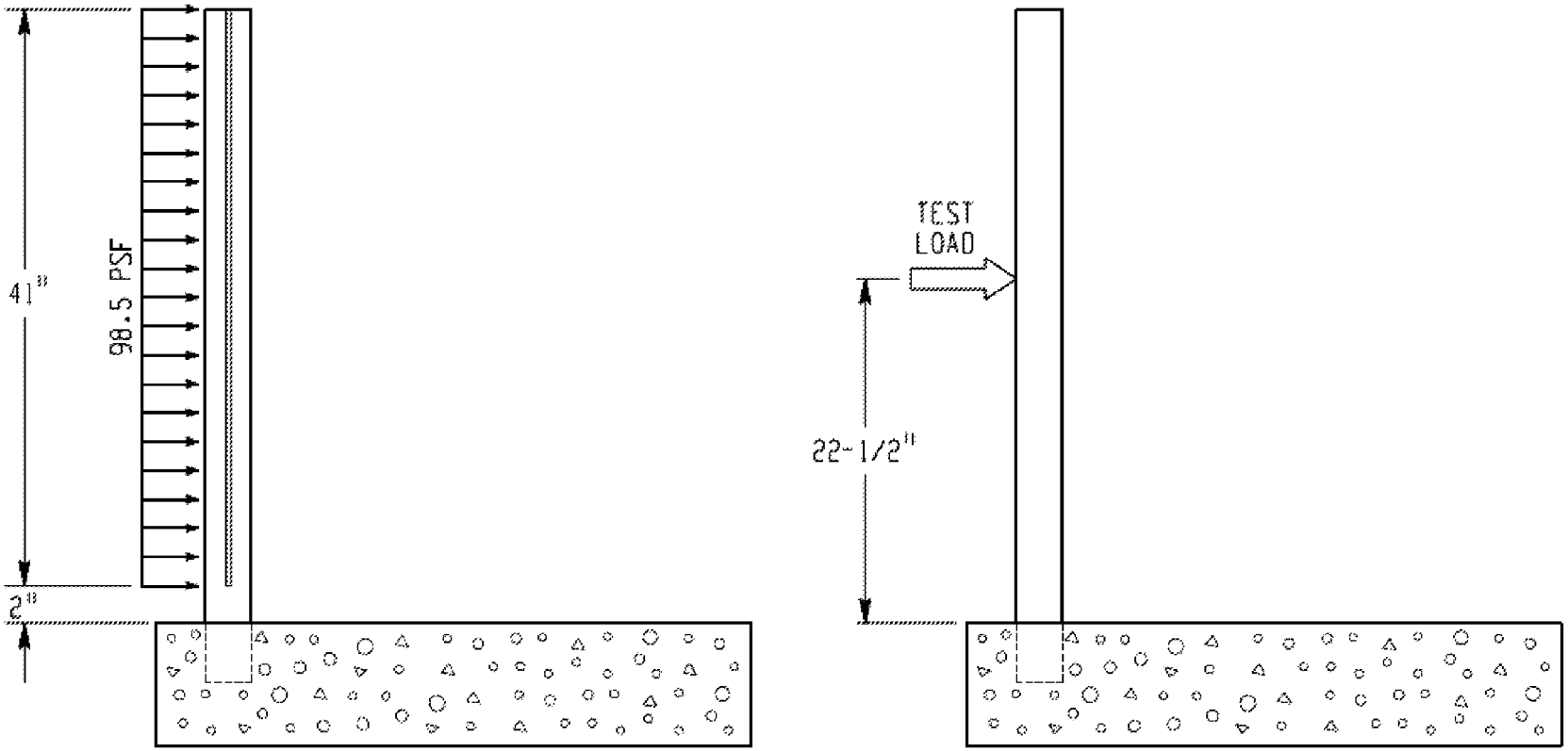
FIG. 7 is a schematic drawing showing the difference between the actual wind loading of a balcony railing and the simulated loading of an embedded post for the testing as described in Example 1.

Table 1 has common railing post design features for balconies in apartment buildings, condominiums and hotels. These features were used to calculate a wind load based on 98.5 psf wind pressure for each particular railing design. The ultimate wind force calculated and shown in Table 2 for each railing post condition is used as the minimum acceptable failure load for each post type. Posts that are able to withstand the ultimate wind force load and do not fail until a load exceeding these values in Table 2 are applied are considered to PASS the test. Posts that fail at a load below the values in Table 2 are considered to FAIL the test. The ultimate wind force values were determined as shown in FIG. 7.

TABLE 1

Existing Post Conditions and Corresponding Design Forces

| Existing Posts | | | | | | |
|---|---|---|---|---|---|---|
| Spacing | Height | Area | | Pressure* | Wind Force (lbs) | |
| (in.) | (in.) | (in.$^2$) | (ft$^2$) | (psf) | Service | Ultimate |
| 30.25 | 41 | 1240.25 | 8.6 | 98.5 | 848 | 1357 |
| 36.7 | 41 | 1504.7 | 10.4 | 98.5 | 1029 | 1647 |
| 37.3 | 41 | 1529.3 | 10.6 | 98.5 | 1046 | 1674 |
| 39.75 | 41 | 1629.75 | 11.3 | 98.5 | 1115 | 1784 |

*Maximum value provided by EOR. Actual wind pressure will vary with height.

TABLE 2

Minimum Acceptable Failure Load for each Post Condition

| Existing Posts | | Corresponding |
|---|---|---|
| Spacing (in.) | Height, Hp (in.) | Test Load, $V_u$ (lbs) |
| 30.25 | 41 | 1357 |
| 36.7 | 41 | 1647 |
| 37.3 | 41 | 1674 |
| 39.75 | 41 | 1784 |

Test Results and Theoretical Model

Tests as described above were carried out and used to verify the ability of the railing post to resist design wind load of 98.5 pounds per square foot ("psf") in a typical railing design without failure of the strengthened slab edge. Furthermore, the test results and observed failure modes were used to develop a theoretical model for predicting the design strength of the strengthened concrete slab.

Example 1 presents the test results and theoretical model for predicting the strength of a railing post embedded in balcony slab with edge strengthened using a surface-embedded GFRP bars.

Table 3 shows the experimental test results ($P_{exp}$) for two posts; one post with 4 in. embedment in a strengthened concrete slab and another post with 3 in. embedment in a second strengthened concrete slab. Both tested concrete slabs showed similar concrete breakout failure modes at an ultimate load. The failure mode of each concrete slab consisted of a concrete cone centered on the post and a partial concrete block removed on each side of the cone as shown in FIG. 3. For the slab with post embedment of 3 in. in the concrete slab (See FIG. 3), the depth of the failure cone extended approximately 6 in. from the top of the slab. For the slab with 4 in. embedment, the depth of the failure cone extended the full depth of the slab (see FIG. 2 and FIG. 3).

TABLE 3

Failure Load

| 4" Embedment $P_{exp}$ (lbs) | 3" Embedment $P_{exp}$ (lbs) |
|---|---|
| 4500 | 3750 |

Analytical Model

Based on the observed failure mode, the projected area of the concrete failure block can be defined by two portions: an inverted parabola 32A and two rectangular portions 32B, one on each side of the parabola (see FIG. 4).

The observed failure mode also indicated that the angle of concrete failure block can be assumed as 35 degrees, as suggested by ACI 318-08 (D.4.2.2).

The length of the base of the parabola can be approximated as $[3c_{a1}+w_p]$ and the depth of the projected area of the concrete failure block as $[h_{ef}+c_{a1}\tan(35°)]$. Therefore, the total projected area of the concrete spall ($A_{vc}$) can be estimated using Eq. (1), as follows:

$$A_{vc} = \frac{2}{3}(3c_{a1} + w_p)(h_{ef} + c_{a1}\tan(35)) - A_{vp} + A_{vb} \quad (1)$$

where, $c_{a1}$=clear edge distance in the direction parallel to the load application $w_p$=width of the railing post cross-section $h_{ef}$=embedment depth of railing post $A_{vp}$=projected area of the embedded portion of the railing post=$w_p h_{ef}$ $A_{vb}$=projected area of the concrete engaged by GFRP bar=$l_b t_b$ $t_b$=length of the of concrete breakout beyond cone due to GFRP bar=Sr.−$(3c_{a1}+w_p)$ where Sr is the spacing of railing posts or in the examples the length of the bar installed in the slab.

The reaction force at the base of the railing post ($V_n$) can be determined using Equation 2, which is based on the approach proposed by Fuchs et al. (ACI Structural Journal, 1995):

$$V_n = 4A_{vc}\sqrt{f'_c} \quad \text{(Equation 2)}$$

where $f'_c$ is the concrete compressive strength.

The data used in each model, 3 inch embedment and 4 inch embedment, is shown in Tables 4 and 5.

TABLE 4

Data used to Determine Strength of an Edge of a Strengthened Concrete Slab with #5 FRP Bars

| Variable | Test Slab with 4 inch embedment | Test Slab with 3 inch embedment |
|---|---|---|
| $h_{ef}$ | 4 inches | 3 inches |
| $c_{a1}$ | 4 inches | 4 inches |
| $S_R$ | 36 inches | 36 inches |
| $w_p$ | 3 inches | 3 inches |
| $f'_c$ | 6200 psi | 6200 psi |
| $V_u$ | 1.647 kip | 1.647 kip |
| H | 22.5 inches | 22.5 inches |
| h | 0 inches | 0 inches |
| $t_b$ | 4 inches | 4 inches |

Figure 8:
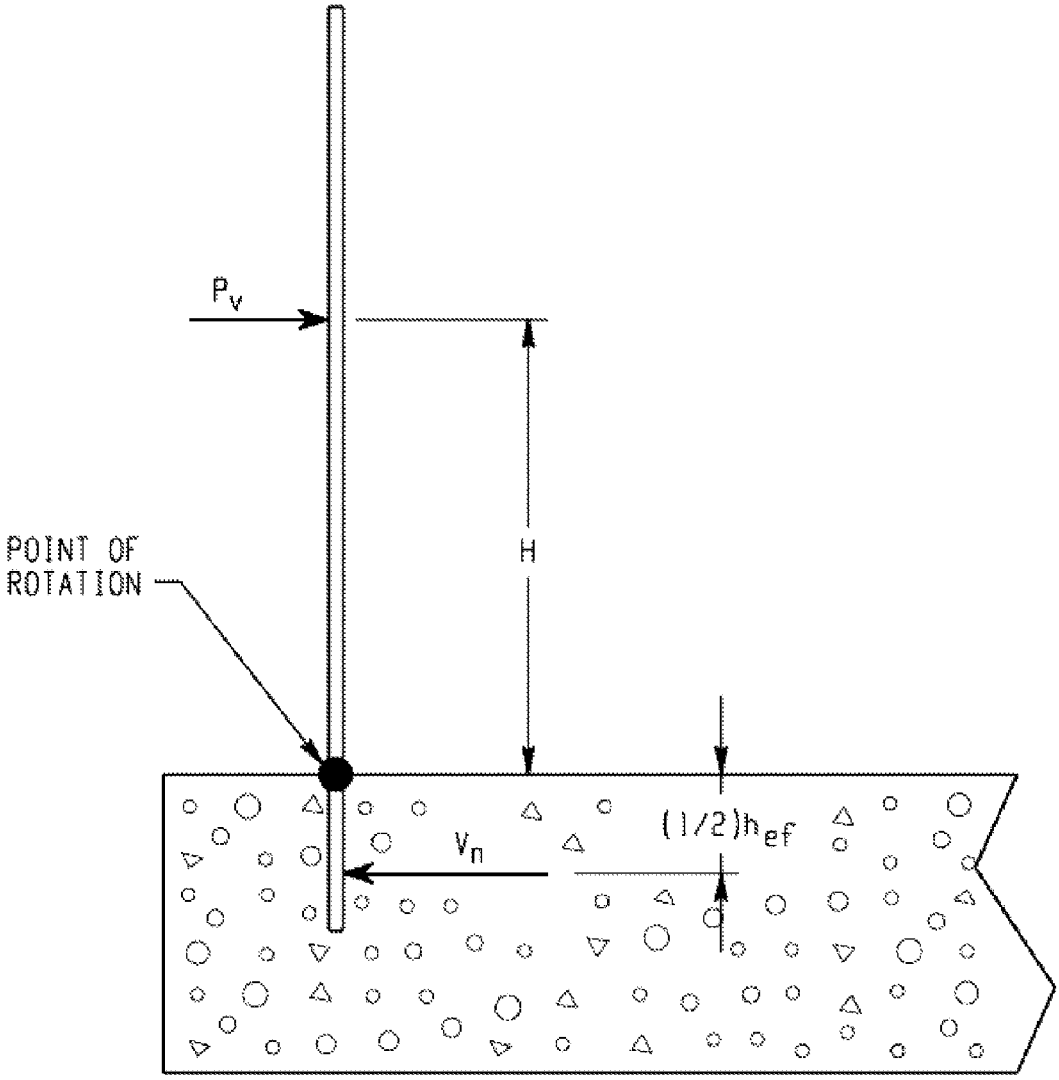
FIG. 8 is a schematic drawing of a test concrete slab showing indicating how data is determined for the method of calculating the forces to be resisted within the concrete slab.

The force causing concrete breakout can be determined assuming that the point of rotation, where h is the distance from the top of the slab to the point of rotation, of the railing post is located at the top of the slab, that the reaction force (in this case $V_n$) is located at the mid-depth of the embedment depth (see FIG. 8) and that the wind force is exerted at a distance measured from top of the slab to the point of lateral load application (H), typically 0.5 (Hp). Table 5 presents a summary of the experimental failure loads and the predicted values ($P_v$) based on the model outlined above. The results indicate that the proposed model is relatively conservative.

In addition, the calculated design shear strengths $\phi P_v$ based on a strength reduction factor of $\phi$=0.7 (ACI 318-08 Section D.4.4) are 1,955 lbs and 2,744 lbs, for 3 in. and 4 in. embedment. In both cases, the design shear strength determined on the model above is greater than the specified factored wind load of 1,647 lbs. See calculations in Table 4 for a post with a 4 inch embedment in the strengthened concrete slab, Table 5 for a post with a 4 inch embedment in the strengthened concrete slab, and a Summary in Table 6.

TABLE 5

Summary of Experimental and Predicted Maximum Load

| Embedment Depth | $P_{exp}$—Experimental (lbs) | $P_V$—Predicted (lbs) |
|---|---|---|
| 3 in. | 3,750 | 2,793 |
| 4 in. | 4,500 | 3,920 |

Failure of the slab with 4 in. and 3 in. embedment occurred at a load of 4,500 lbs and 3,750 lbs, respectively. Both failure loads are significantly higher than the maximum specified test load of 1,647 lbs. of the design wind force. Accordingly, both strengthened slabs edges are considered to PASS the test.

An analytical approach was developed based on observed failure condition to determine the strength of the slab-edge strengthened with FRP bar produced conservative estimate when compared with the failure load for each test specimens.

The embodiments of the described method and strengthened concrete slab are not limited to the particular embodiments, method steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

What is claimed is:

1. A method of increasing a break out capacity of a concrete structure from an initial break out capacity to a reinforced break out capacity, the concrete structure comprising a railing positioned in proximity to at least a portion of an edge of the concrete structure, the method comprising: cutting a groove adjacent an edge of said concrete structure in front of a railing post; inserting a rod into the groove; and filling the groove with a polymeric resin; in said concrete structure having a top surface with edges, wherein the concrete structure has at least one railing post embedded in the concrete structure, wherein the reinforced break out capacity of a portion of the concrete structure adjacent one or more of said at least one railing post after reinforcement is greater than the initial break out capacity of the same portion of the concrete structure adjacent the same one or more of said at least one railing post before reinforcement.

2. The method of claim 1, wherein inserting a rod and polymeric resin into at least a portion of the groove comprises inserting the rod into the groove and then filling the groove with the polymeric resin.

3. The method of claim 1 further comprising applying an adhesive resin to at least a portion of the groove.

4. The method of claim 1, wherein the rod is non-metallic.

5. The method of claim 1, wherein the rod is one of a glass fiber reinforced rod or a graphite fiber reinforced polymer.

6. The method of claim 1, wherein the concrete structure comprises a balcony extending from a wall structure.

7. The method of claim 1 further comprising:

determining the reinforced break out capacity; and determining at least one of groove, rod and polymeric resin characteristics in order to increase the break out capacity from the initial break out capacity to the reinforced break out capacity.

8. The method of claim 7, wherein groove characteristics are selected from the group consisting of groove depth, groove length, groove shape and groove location in the concrete structure.

9. The method of claim 7, wherein rod characteristics are selected from the group consisting of rod length, rod shape, rod strength and rod location in the groove.

* * * * *